US005211494A

United States Patent [19]

Baijnath

[11] Patent Number: 5,211,494

[45] Date of Patent: May 18, 1993

[54] BATH BRUSH-BACKSCRATCHER FOR CLEANSING AND STIMULATING ONE'S SKIN

[76] Inventor: Etienette Baijnath, #609, T20 Raglan Avenue, Toronto, Ontario, Canada, M6C 2L4

[21] Appl. No.: 710,014

[22] Filed: Jun. 4, 1991

[51] Int. Cl.[5] ..... A46B 11/00; A46B 11/02; A46B 9/06

[52] U.S. Cl. ..... 401/28; 401/37; 401/39; 401/184; 401/280; 15/106; 15/110; 15/114

[58] Field of Search ..... 401/28, 185, 184, 280, 401/37, 39, 28; 15/106, 107, 110, 159 A, 114

[56] References Cited

U.S. PATENT DOCUMENTS

| | | | |
|---|---|---|---|
| 1,012,653 | 12/1911 | Knickerbocker | 401/28 |
| 1,065,256 | 6/1913 | La Mar | 401/184 |
| 1,485,126 | 2/1924 | Schumacher | 401/185 X |
| 1,605,651 | 11/1926 | Doi | 15/110 |
| 1,939,344 | 12/1933 | Garland | 401/28 |
| 1,965,344 | 7/1934 | Josinsky | 401/28 |
| 2,218,471 | 10/1940 | Hickey | 401/28 X |
| 2,516,491 | 7/1950 | Swastek | 401/28 |
| 2,814,060 | 11/1957 | Aschenbach | 401/39 X |
| 2,920,333 | 1/1960 | Montague et al. | 401/140 X |
| 3,467,978 | 9/1969 | Golden | 15/114 X |
| 3,668,732 | 6/1972 | Lardenois | 15/159 A |
| 4,319,852 | 3/1982 | Bell et al. | 401/185 |
| 4,543,913 | 10/1985 | Wilkenson | 401/28 X |
| 4,902,154 | 2/1990 | Valenza | 401/28 X |

FOREIGN PATENT DOCUMENTS

| | | | |
|---|---|---|---|
| 64859 | 8/1913 | Austria | 401/280 |
| 904687 | 7/1949 | Fed. Rep. of Germany | 15/110 |
| 2257115 | 5/1973 | Fed. Rep. of Germany | 401/184 |
| 3639424 | 6/1988 | Fed. Rep. of Germany | 15/110 |
| 25207 | 2/1952 | Finland | 401/28 |
| 1403170 | 5/1965 | France | 401/28 |
| 2975 | of 1893 | United Kingdom | 15/110 |
| 804332 | 11/1958 | United Kingdom | 15/114 |

*Primary Examiner*—Steven A. Bratlie

[57] ABSTRACT

A cleansing and stimulating brush that doubles as a backscratcher having sufficiently firm construction means approximating the function of human nails for scratching and stimulating one's skin, combined with brush means comprising slender stalklike projections for stimulating and cleansing the skin, and including interspersing smooth protuberance means approximating the soft pads of one's finger tips for pleasant touch sensations. This device further includes a soap applicator means to which soap can be applied for further application to the skin. The device can be adapted to contain and dispense liquid soap.

5 Claims, 3 Drawing Sheets

BATH BRUSH-BACKSCRATCHER FOR CLEANSING AND STIMULATING ONE'S SKIN

BACKGROUND OF THE INVENTION

1. Field of the Invention

The present invention relates to brushes and backscratchers for use in cleansing and stimulating one's skin with means for pleasant touch sensations.

2. Prior Art

In the past there have been and there are currently several types of devices for cleansing and stimulating one's skin. The present invention differs from prior inventions in that it is adapted to approximate one's hand and by virtue of the function of its structures it is a more natural type of cleansing device.

SUMMARY OF THE INVENTION

A new and improved combination of a bath brush and a backscratcher comprising sufficiently firm construction means approximating one's nails, brushing means of slender stalklike projections, interspersing smooth flexible protuberance means, and soap applicator means, and can be adapted to contain and dispense liquid soap. This device will particularly be of benefit to arthritic or disabled persons for reaching body parts that are hard to reach.

BRIEF DESCRIPTION OF THE DRAWINGS

The present invention is described in the illustration of the drawings below.

DESCRIPTION OF THE PREFERRED EMBODIMENT (S)

Several versions of the embodiments of the present invention can be created depending on choice of materials, design and purpose for use. The preferred embodiments of one version of the invention are described and illustrated below, with the accompanying drawings above exampling but not limiting the embodiments of the invention.

Figure 1:
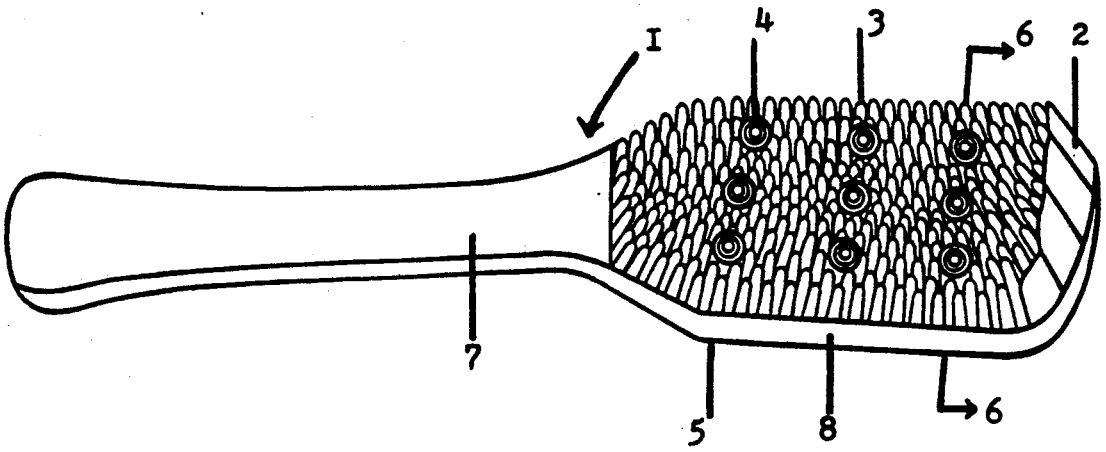
FIG. 1 is a vertical perspective view of one version of the embodiments of the invention.

Referring to FIG. 1 there is shown a brush-backscratcher 1 of the preferred embodiments of the present invention. Projecting from the brush-backscratcher is a sufficiently firm construction means 2 approximating the human nails for stimulating one's skin. Projecting from the base 8 of the brush-backscratcher are repetitively interrupted structures comprising flexible slender stalklike features 3 for brushing the skin, combined with sufficiently flexible smooth protuberance means 4 approximating the soft pads of one's finger tips.

Figure 4:
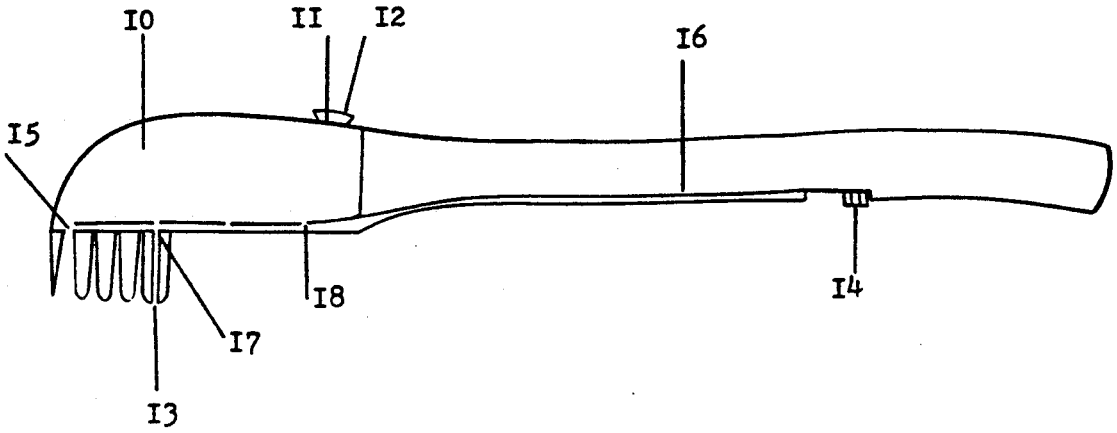
FIGS. 4 and 5 show embodiments of the device with supply compartments.
Figure 5:
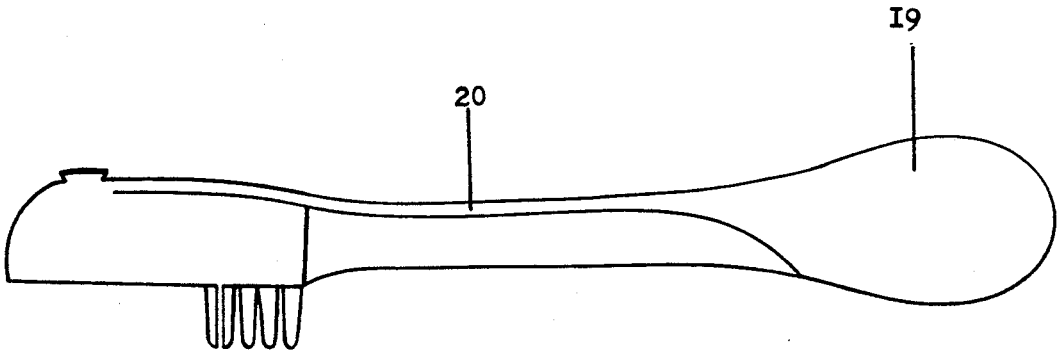

The base 8 is extended to form the handle 7. The base and the handle can be made of natural materials, for example wood, or of synthetic materials, for example nylon. The base 8 and smooth protuberance means 4 can vary in width and circumference respectively and in length and in depth as desired. Referring to FIG. 4 the base 8 can be adapted to be a liquid soap container-dispenser, 10 wherein the container in the base can have a port 11 with a cap 12 for filling and retaining liquid soap and the smooth protuberance means can be adapted to be nipples 15 for dispensing the soap. The flow of soap can be controlled by an ON-OFF switch, 14 in the handle 7, and air vent 15 and firm perforated sliding plate means 16, in the container in the base. The sliding plate means lies over the mouths of the air vent and smooth protuberance 17 means and is connected to the ON-OFF switch. Pushed in the ON position the switch shifts the sliding plate placing the perforations 18 over the mouths of the air vent and nipple means thus opening these means permitting the flow of soap. Pushed in the OFF position the switch shifts the sliding plate placing unperforated areas of the plate over the air vent and nipple means occluding these means and stopping the flow of soap. In FIG. 5 there is shown an alternate flow control apparatus wherein the flow of soap from the container can be controlled by air squeeze-pump means 19, built into the handle of the invention and connected to said container by a duct 20 in the handle.

Figure 6:
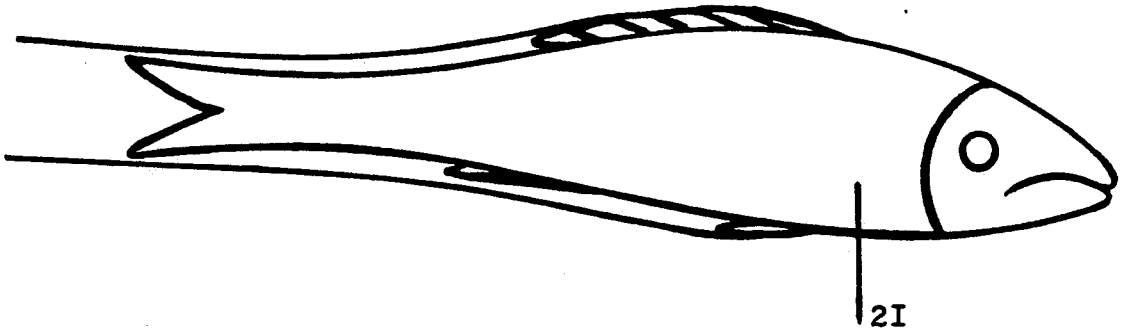
FIGS. 6 and 7 show decorative handles that may be used with the device
Figure 7:
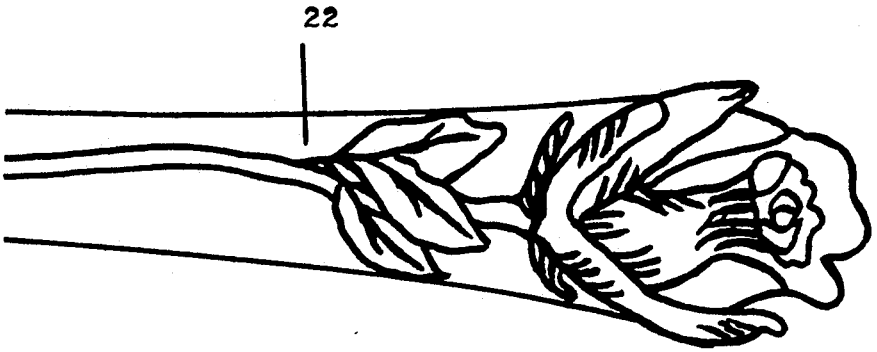

FIG. 6 shows the handle of the invention adapted to be user friendly handle 21 or decorative handle 22 in FIG. 7.

Figure 2:
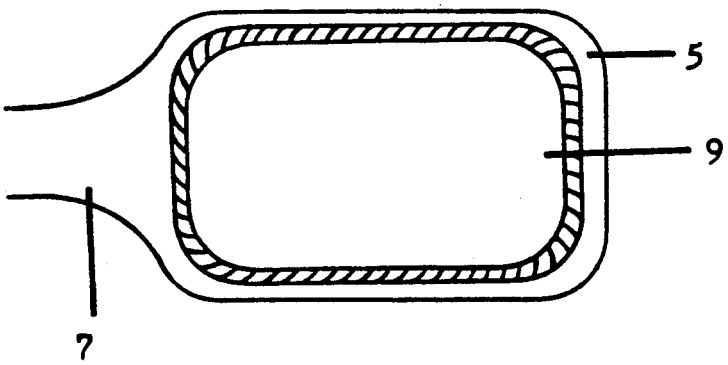
FIG. 2 is a top view of one form of soap applicator means on the back of one version of the invention.

Shown in FIG. 2 is a replaceable soap applicator means 9 for example a sponge, on the back 5 of the brush-backscratcher 1.

Figure 3:
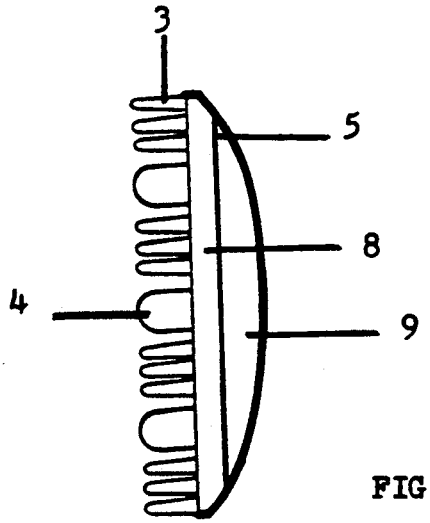
FIG. 3 shows a sectional view of one form of the body of the invention through line 6—6 in FIG. 1 showing structures of the brush component and a soap applicator means.

FIG. 3 is a sectional view of line 6—6 showing one form of the layout of the repetitively interrupted structures comprising slender stalklike features 3 and interspersing flexible, smooth protuberance means 4, all projecting from the base 8 of the brush-backscratcher 1. There is also shown a soap applicator means 9 attached to the back 5.

I claim:

1. A brushing and scratching device for providing pleasant touch sensations and for cleansing and stimulating the user's skin, said device made in a plurality of sizes and comprising:

a body having a back and a base, a soap applicator means secured to the back, a handle extending from the base, and a combination of an array of sufficiently firm, broad human nail-like structures, and an array of sufficiently flexible smooth protuberances surrounded by an array of repetitively interrupted flexible slender stalklike bristles, all projecting adjacently from the base and forming the pleasurable, brushing, scratching and cleansing surface of the brush.

2. A combination of a decorative imaged handle and a brushing scratching device of claim 1, comprising:

a body having a back and a base, a soap applicator means secured to the back, a decorative image handle extending from the base and replacing the ordinary handle, a combination of an array of sufficiently firm, broad human nail-like structures, and an array of sufficiently flexible smooth protuberances surrounded by an array of repetitively interrupted flexible slender stalklike bristles, all projecting adjacently from the base and forming the pleasurable brushing, scratching and cleansing surface of the brush.

3. A combination of a liquid soap container, dispensing means, flow control means and a brushing scratching device of claim 2, comprising:

a body having a back and a base, a soap applicator means secured to the back, a decorative imaged handle extending from the base and replacing the ordinary handle, a combination of an array of sufficiently firm, broad human nail-like structures, and an array of sufficiently flexible smooth protuberances surrounded by an array of repetitively interrupted flexible slender stalklike bristles, all projecting adjacently from the base, wherein the upper part of the base is adapted to be an integral container having a port and a cap for filling and retaining liquid soap and an array of perforations in its bottom, additionally the smooth protuberances are adapted to be nipple means wherein a a narrow duct extends from each perforation in the bottom of the container to a small hole in the tip of each protuberance for dispensing liquid soap, said container having liquid flow control means comprising air vent means positioned in the bottom of the container; and a sliding plate means, lying over the perforations and air vent means, being connected to an ON-OFF switch in the handle of the device, said sliding plate means having an array of perforations that may be aligned or out of alignment with the perforations and air vent means in the container by pushing the ON-OFF switch into the aligned "ON" position to permit the flow of soap, or into the out-of-alignment "OFF" position to stop the flow of soap.

4. A combination of a liquid soap container, dispensing means, air squeeze pump means and a brushing scratching device of claim 2, comprising:

a body having a back and a base, a soap applicator means secured to the back, a decorative imaged handle extending from the base and replacing the ordinary handle, a combination of an array of sufficiently firm, broad human nail-like structures, and an array of sufficiently flexible smooth protuberances surrounded by an array of repetitively interrupted flexible slender stalklike bristles, all projecting adjacently from the base, wherein the upper part of the base is adapted to be an integral container having a port and a cap for filling and retaining liquid soap and an array of perforations in its bottom; additionally the smooth protuberances are adapted to be nipple means wherein a narrow duct extends from each perforation in the bottom of the container to a small hole in the tip of each protuberance for dispensing liquid soap, said container having liquid flow control means comprising air squeeze pump means, wherein the air squeeze pump connects with the container by a narrow duct in the top of the handle and back of the brush ending in the top frontal area of the back of the brush, for dispensing liquid soap by the application of air pressure to the liquid soap in the container each time the user squeezes the air pump.

5. A combination of a user friendly imaged handle and a brushing scratching device of claim 1, comprising:

a body having a back and a base, a soap applicator means secured to the back, a user friendly imaged handle, imaged to be friendly for children and replacing the ordinary handle, a combination of an array of sufficiently firm, broad human nail-like structures, and an array of sufficiently flexible smooth protuberances surrounded by an array of repetitively interrupted flexible slender stalklike bristles, all projecting adjacently from the base and forming the pleasurable, brushing, scratching and cleansing surface of the brush.

* * * * *